United States Patent [19]

Wik

[11] 4,080,663

[45] Mar. 21, 1978

[54] MAGNETIC STIRRER

[76] Inventor: Gunnar Wik, 46 Rosbacken, Vallingby, Sweden, S-162 40

[21] Appl. No.: 775,153

[22] Filed: Mar. 7, 1977

[30] Foreign Application Priority Data

Mar. 9, 1976 Sweden ..... 7603119

[51] Int. Cl.[2] ..... B01F 13/08; B01F 7/00

[52] U.S. Cl. ..... 366/274

[58] Field of Search ..... 259/1 R, DIG. 46, 27, 259/21, 22, 23, 24, 40, 41, 43, 44, 5–8, 64, 65, 66, 67, 102, 107, 108; 310/103, 104

[56] References Cited

U.S. PATENT DOCUMENTS

| | | | |
|---|---|---|---|
| 2,513,082 | 6/1950 | Dreyfus | 259/1 |
| 3,206,172 | 9/1965 | Gaska | 259/27 |
| 3,680,843 | 8/1972 | Fullerton | 259/64 |
| 3,749,369 | 7/1973 | Landsberger | 259/DIG. 46 |
| 3,985,649 | 10/1976 | Eddelman | 259/DIG. 46 |
| 3,997,272 | 12/1976 | George | 259/DIG. 46 |

FOREIGN PATENT DOCUMENTS

| | | |
|---|---|---|
| 1,156,206 | 6/1969 | United Kingdom. |

*Primary Examiner*—Robert W. Jenkins
*Attorney, Agent, or Firm*—Fitch, Even, Tabin & Luedeka

[57] ABSTRACT

A magnetic stirrer for stirring a fluid in a vessel where a stirring rotor in form of a permanent bar magnet is easily movable for rotation by means of an externally applied rotating magnet field. Said field is set up by four magnet coils arranged in a parallel relationship to form a square configuration and fed by respective phase-shifted a.c. currents, the common center axis of the coils being aligned with the rotor in the overlying vessel. A plate of mu-metal is arranged in said center axis and adjacent the bottom of the vessel to concentrate the longitudinal magnet flow lines of the coils for interaction with the flow lines of the rotor to maintain the rotor centered.

4 Claims, 5 Drawing Figures

MAGNETIC STIRRER

The present invention refers to a magnetic stirrer comprising a stirring rotor in form of a permanent bar magnet easily movable in a vessel containing the fluid to be stirred, said rotor being rotated by an externally applied rotating magnet field set up by at least one pair of parallelly disposed magnet coils supplied with respective phase shifted a.c. currents and having opposite magnetomotive forces, said coils being positioned below the vessel.

Such small stirrers are used in various research fields where a uniform concentration or a uniformly distributed temperature (e.g. in heating operations) is desired in a liquid in a test container (cup, retort), as well as a rapid solution of substances and mixing or elutriation of liquids - and also for preventing the elutriation substances from sinking to the bottom during long-time measurements.

In the hitherto mostly used conventional stirrers the rotating magnet field for driving the rotor is produced by a permanent magnet positioned below the vessel and rotated by an electric motor, said permanent magnet being aligned with the rotor and magnetically coupling it to rotate at the same speed. This device is, due to the presence of moving mechanical parts, subjected to wear and is less reliable, complicated for continuously adjusting the speed and so bulky that it is difficult to use in the spectrophotometry and fluorometry fields, far less allowing a mounting within available photometers and similar apparatus.

It has, therefore, been suggested to produce the rotating magnet field by means of a cross-coil system, supplied from a two-phase a.c. current source having a phase shift of 90°. However, the proposed construction has not fulfilled the expectations. Thus, other magnet fields in the vicinity, as e.g. from relays, other electromagnets or permanent magnets, interfered with the system. The rotor tended to jump or lock itself to a pole of the electromagnet. When changes in the rotative speed of the driving magnet flow were made for adjusting the speed of the rotor, the magnet field was disturbed so that the rotor readily fell out of the magnetic coupling. Due to the sensibility of the stirrer to adjacent extraneous magnet fields, it was further not possible to develop the idea to include two or more stirrers beside each other as the individual magnet fields of the rotors interfered with each other so that the rotors moved jerkily or attracted each other.

These factors preventing the realization of a fully operative stirrer according to the principle suggested are eliminated through the invention in that, at a location aligned with the centre of the rotor and in or adjacent the common centre axis of the coils, a plate of mu-metal or some other soft-magnetic material having similar shielding properties is provided adjacent the bottom of the vessel.

The invention is described in more detail while referring to the accompanying drawings.

Figure 1:
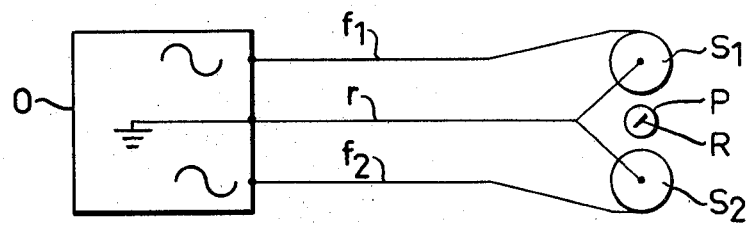
Figure 2:
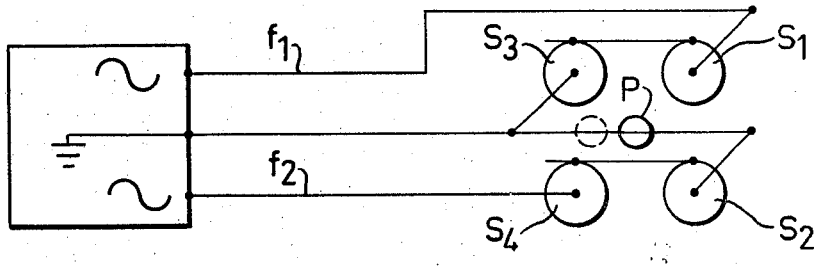
Figure 3:
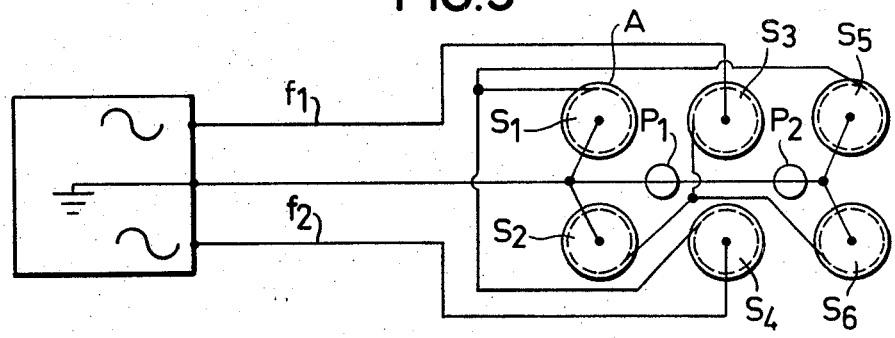
Figure 4:
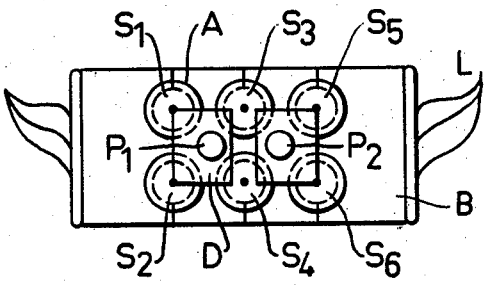
Figure 5:
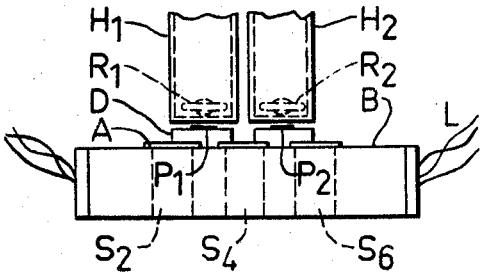

In these, FIGS. 1-3 show schematic views of a first, a second and a third embodiment, respectively, of the magnetic stirrer according to the invention, and FIGS. 4 and 5 show a schematic plan view and a side view, respectively, of the mechanical structure of the third embodiment, comprising double stirrers, the side view also suggesting the positioning of the test containers with respective rotors.

The principal arrangement according to FIG. 1 comprises a conventional oscillator (including an amplifier) O having two drive phase lines $f_1$ and $f_2$ extending to a different one of two parallelly disposed magnetic coils $S_1$ and $S_2$, respectively, having a common return or neutral line r. It is indicated symbolically that the coils have opposite mmf:es (i.e. magnetomotive forces). Between the coils and, preferably, at a somewhat higher level than the tops thereof a plate P of mu-metal (an alloy of nickel and iron) is provided. Positioned over the centre of the plate P and adjacent thereto is the particular test container (H in FIG. 5) including the permanent bar magnet, providing the stirrer rotor, said magnet being indicated at R. The currents in the phase lines $f_1$ and $f_2$ are phase shifted 90° with respect to each other. This fact in combination with the opposite mmf:es of the coils results in such alternating magnetic polarities of the coils that they subject the rotor poles to alternatingly attracting and repelling magnetic flows to produce a travelling or rotating magnet field for bringing along the rotor R. The frequency of the magnet field, i.e. the revolution speed of the rotor, can be adjusted from the oscillator O.

The function of the mu-plate is of the utmost importance as the plate, by concentrating the longitudinal flow lines of the coils in cooperation with the flow from the rotor, brings about such a strong centering of the rotor that its movements will not be disturbed even by very close extraneous magnet fields.

The above arrangement, however, has certain disadvantages in that the direction of movement cannot be controlled, and the presence of dead points may result in a stopping of the rotor or making the start of it difficult.

By supplementing the single pair of coils $S_1$ and $S_2$ with a second pair of coils $S_3$ and $S_4$ in a square configuration and supplied from the same phase lines as the first pair, as shown in the embodiment of FIG. 2, a rotating magnet field having a full encircling free from any dead points is obtained. In this case the rotor R is positioned substantially in the common centre of the four coils. The centering effect of the mu-plate P on the rotor will, however, be so amplified by the increased magnet field encircling that the plate, if required, may be displaced a considerable distance from the geometric centre of the coils (indicated by dashed lines); alternatively the coil configuration needs not be strictly symmetrical. This flexibility may be of great importance in view of space requirements.

The two embodiments discussed above have referred to single stirrers. However, one has very often use for double stirrers rather close to each other, e.g. for a first container holding a reference sample and for a second container holding a test sample. Instead of using double coil sets according to FIG. 2, i.e. in total eight coils, it is possible to manage with only six coils by using the arrangement shown in FIG. 3, with no deterioration of the operation, which naturally means a simplification with great advantage from both economic and spatial view.

This saving of two coils is obtained by making a coil pair $S_5$ and $S_6$ form an additional square formation together with the coils $S_3$ and $S_4$, a mu-metal plate $P_2$ being positioned in the centre area, and fed in parallel with one of the remaining pairs, in the case shown the most remote coil pair 1 and 2. Especially with this embodiment - but also in some degree with the double stirrer according to FIG. 2 - it has been found that the reliability can be further increased by disposing flow-shielding disks A of mu-metal adjacent to or on the top surface of the coils. These disks should not be appreciably larger than the transverse section of the coils in order not to unduly shield the effective magnetic flow.

As regards the size of the mu-plates P, the rule is that the smaller the plate, the finer will the centering of the rotor be but the weaker the centering force, and vice versa. The optimal value is, thus, depending of the other magnetic parameters of the stirrer.

To the double stirrer of FIG. 3 further coil pairs may be added, in accordance with the principle there shown, to obtain three or more stirrers.

FIGS. 4 and 5 show examples of the mechanical structure of the double stirrer in FIG. 3. In said Figures the six coils $S_1$-$S_6$, inclusive applied mu-metal plates, are housed in a block B supporting spacing members D of plastic or some other non-magnetic material for carrying the mu-metal plates $P_1$ and $P_2$. At L the two input drive phase lines and the neutral line are indicated. In the side view of FIG. 5 also the lower part of test containers $H_1$ and $H_2$ with internal rotors $R_1$ and $R_2$ is indicated, said rotors having a convex middle portion for the journalling against the bottom of the test container.

The embodiments described above are only intended to serve as examples of possible embodiments. Therefore, the invention is not restricted to what has been shown and described but various modifications within the scope of the invention should be obvious to one skilled in the art. However, it should be observed that the phase shift between the currents in the two drive phases could differ from 90°. Further the stirrer may be provided with a pumping effect by forming the bar magnet in shape of an impeller, or an impeller could be fixed to the bar magnet. A pump obtained in this way may advantageously be used in applications where relatively small effects are required, e.g., in aquaria.

What I claim is:

1. A magnetic stirrer comprising a stirring rotor in form of a permanent bar magnet which is easily movable in a vessel containing a fluid to be stirred, at least one pair of parallelly disposed magnet coils, supplied with respective phase-shifted a.c. currents to induce opposite magnetomotive forces in said coils, resulting in a rotating magnet field, said vessel being positioned near the top plane of said coils and having the rotor substantially aligned with the common centre axis of the coils, so that the rotor is rotated by said rotating magnet field, a plate of a soft-magnetic material having magnetic shielding properties, such as mu-metal, being positioned adjacent the bottom of said vessel and substantially in said common centre axis of the coils.

2. A magnetic stirrer according to claim 1, comprising two pairs of coils arranged in a substantially square formation, each pair being supplied from a different phase line of an a.c. voltage source, the plate of mu-metal being provided in the common centre area of the four coils and located adjacent the bottom of said vessel.

3. A magnetic stirrer according to claim 2, comprising an additional pair of coils forming, together with one of the two remaining pairs, another square formation, said additional pair of coils having a phase supply line common with the other of these coil pairs, a second plate of mu-metal being positioned in the central area of said additional square formation to act upon a rotor in a second overlying vessel.

4. A magnetic stirrer according to claim 1, wherein disks of mu-metal also are placed over each of the coils, said disks being of a size to cover the top surface of said coils.

* * * * *